US006160227A

United States Patent [19]

Singer

[11] Patent Number: 6,160,227

[45] Date of Patent: Dec. 12, 2000

[54] TOGGLE SWITCH STOP

[75] Inventor: Keith A. Singer, Cambridge, Md.

[73] Assignee: Airpax Corporation, LLC, Frederick, Md.

[21] Appl. No.: 09/177,963

[22] Filed: Oct. 23, 1998

[51] Int. Cl.[7] ..... H01H 9/28

[52] U.S. Cl. ..... 200/43.14; 200/43.15; 200/43.16

[58] Field of Search ..... 200/43.14–43.15, 200/43.16, 43.19

[56] References Cited

U.S. PATENT DOCUMENTS

| | | | |
|---|---|---|---|
| 2,937,248 | 5/1960 | Michetti | 200/44 |
| 4,435,624 | 3/1984 | Sepulveda | 200/42 T |
| 4,644,114 | 2/1987 | Strobel | 200/50 C |

*Primary Examiner*—M. L. Gellner
*Assistant Examiner*—Nhung Nguyen
*Attorney, Agent, or Firm*—Milde, Hoffberg & MacKlin, LLP

[57] ABSTRACT

A retaining element for a toggle switch, including an elongated toggle member which pivots about an axis with respect to a switch body, having an attachment portion, connecting the retaining element to the elongated toggle member and being adapted to supply a force against the elongated toggle member to hold the toggle in a defined position, a connecting arm, extending from the attachment, adapted to supply a force in the defined position against the body with respect to a path of movement of the elongated toggle member, and a manually graspable member, adapted to transmit a force for displacing the attachment from the defined position.

16 Claims, 6 Drawing Sheets

TOGGLE SWITCH STOP

FIELD OF THE INVENTION

The present invention relates to the field of toggle switch stops, and more particularly to a member which prevents accidental switching of a toggle from a first position to a second position with respect to a switch body.

BACKGROUND OF THE INVENTION

Toggle switches are well known, especially in the electrical arts. These toggle switches typically provide a manually accessible member which has metastability in a first position and a second position. For example, these positions may represent "ON" and "OFF". In many instances, these toggle switches are readily accessible and intended for casual use, for example domestic lighting. Accidental use of the toggle carries a very low penalty, and feedback of the resulting position is immediately apparent. Thus, no interlock or positional retaining means need be provided.

See, e.g., U.S. Design Pat. No. 274,326; U.S. Pat. Nos. 5,744,768; 5,557,082; 5,463,199; 5,361,051; 5,293,016; 5,214,402; 5,162,765; 5,117,208; 5,066,935; 4,528,531; 4,488,133; 4,347,488; 4,024,894; 3,959,755; and 3,863,042.

Some situations provide a substantial penalty for accidental actuation. For example, during repair or installation, accidental actuation may result in electrocution or shock. Therefore, where a worker is not in the immediate vicinity of a switch and is in the process of installation, repair or maintenance, often a lock or flag is placed to alert others that the switch should not be reset or to prevent resetting without significant efforts.

Finally, a number of applications pose a significant penalty for accidental actuation of a switch, but do not require a lockout or obtrusive warning, and do not interfere with normal operation of the switch. For example, in a process control system, inappropriate actuation or deactuation of a control switch may result in scrapping of an entire production lot.

A known toggle switch switch retention system, shown in FIGS., 1A, 1B and 1C, provides a flat spring element adjacent to the toggle which engages a hole in the toggle, thereby preventing actuation without manipulation of the spring element. This flat spring element must be attached to the switch body in order to be effective, and thus requires a modification of the switch itself Further, the manipulation of the spring element is potentially inconvenient.

SUMMARY AND OBJECTS OF THE INVENTION

According to the present invention, a toggle switch retention element is provided which is attached to the toggle, and by repositioning with respect thereto selectively engages in form fit manner to retain the toggle in a fixed position. Preferably, the retention element will symmetrically retain the toggle in both first and second positions, but this is not necessary, and indeed it is possible to provide a retaining element which is operative for retaining a toggle switch only in a first position, while allowing it to freely move from the second position.

Thus, in the case of a circuit breaker system, it is desired to provide a retaining element which retains the circuit in the "OFF" position when engaged, but which freely allows the toggle to move between the "ON" and "OFF" positions when disengaged.

Advantageously, the retaining element is affixed by a pivot member with a distal portion of the toggle, and provides a portion displaced from the pivot member which engages a portion of the switch body near the junction with the toggle. Thus, in a first configuration, the retaining member engages the portion of the switch body near the junction with the toggle to prevent movement from a first position of the toggle, while in a second configuration, the retaining member is displaced from the engaging position, and thus does not impede movement of the toggle. In a symmetric embodiment, the retaining member has two configurations in which it engages the same or different portions of the switch body respectively near the junction with the toggle, and thus will retain the toggle in two respective different positions, e.g., "ON" and "OFF".

Advantageously, the retaining member has a configuration, e.g., the second configuration described above, which does not interfere with normal operation of the toggle. In one preferred embodiment, the retaining element is compatible with standard toggle switches, and thus does not require differences in manufacturing. An example for application is a 15 Amp circuit breaker. Typically, such circuit breakers are provided with a toggle having a hole formed near the end, allowing a rod to be inserted therethough for tying multiple poles together. This hole may be employed as the pivot position of the retaining element. In this case, the retaining element preferably is provided as an integral element with the pivot member.

On the other hand, where the hole in the toggle is employed for other purposes, such as a connecting bar, a connecting bar may pass through the retaining element, of the retaining element may be integral with the connecting bar, thus limiting repositioning of two or more poles of a multipole circuit.

Since the toggle is often intended for manual operation, the retaining element affixed to the toggle may be ergonomically designed for operation by a human hand of normal proportions. Therefore, the retaining element affixed to the toggle is preferably shaped to be readily grasped between thumb and forefinger, with the retaining element in an unengaged position, for repositioning of the toggle, and to provide a protruding portion suitable for manual displacement of the retaining element from an engaged, retaining position to an unengaged position.

The preferred configuration of the retaining element for a circuit breaker is a "V" shaped distal portion, attached to an arm with a cylindrical extension which pivots within the hole in the toggle. One side of the "V" shaped distal portion is adapted to fit into the recess between the toggle and the switch body, locking the toggle against movement when engaged. The other side of the "V" shaped distal portion protrudes from the recess, and therefore may be pulled to allow the retaining element to be disengaged. Advantageously, both the retaining element and external mechanical configuration of the switch body are symmetric, so that the retaining element can engage the switch in either toggle position.

One known switch body configuration provides a dome-like or semicircular protrusion from the body-proper of the switch, surrounding the toggle recess. In this case, the retaining element preferably clears the dome-like or semicircular protrusion, to prevent mechanical interference therewith.

As stated above, it may be desirable to provide an asymmetric arrangement, in which the toggle is retained in one position, e.g., "OFF", while allowing the toggle to be manually or automatically switched to the other position, e.g., "ON", without interference. In this case, the "V"

shaped distal portion of the preferred embodiment is replaced with an asymmetric configuration, which prevents engagement in one switch position and allows engagement in another switch position. For example, the engaging portion is provided as half of a "V", while the non-engaging portion is adapted to prevent engagement. This may be achieved in a single design by providing the retaining element with frangible "ears" which prevent engagement, but which may be removed to allow engagement. These ears may be provided on one or both sides.

In a single pole toggle, the retaining element is preferably integral with a pivot axis member, which passes through a hole in the toggle, and is held in place with a standard retaining clip. In a multi-pole toggle, the retaining element may have an aperture designed for a rod, which connects the multiple poles, to pass through, and about which the retaining element may rotate. Alternately, the retaining element may be integral with the multi-pole linking element, and the retaining element may engage the switch body of one or more pole bodies.

Where the switch provides a color indication of switch status, and the retaining element interferes with line-of-sight viewing, the retaining element is preferably transparent to allow the color indication to be seen therethrough. Alternatively, the switch may be formed of an opaque material with the visible (outwardly facing) surface of the retaining element color coded or imprinted to indicate the state of the switch. For example, a red color and/or the numeral "1" or word "ON" may be used to indicate "ON", while a black color and/or the numeral "0" or word "OFF" may be used to indicate "OFF".

It is therefore an object according to the present invention to provide a toggle switch retaining element adapted to selectively retain a toggle in a predetermined position, which may be affixed to the toggle switch and whose fundamental design does not require modifications to the switch body.

It is a further object according to the present invention to provide a retaining element for a switch that is adapted to be manually engaged and disengaged for discouraging undesired changing of switch position.

These and other objects shall become apparent through a description of the preferred embodiments of the invention.

These and other objects and features of the present invention will become more fully apparent from the following description and appended claims taken in conjunction with the accompanying drawings.

DETAILED DESCRIPTION OF THE PREFERRED EMBODIMENTS

Figure 1A:
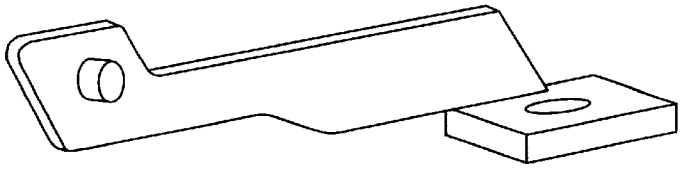
FIG. 1A PRIOR ART
FIGS. 1A, 1B and 1C show front perspective view, a side perspective view and a side perspective view in its intended environment of operation of a switch handle stop.
Figure 1B:
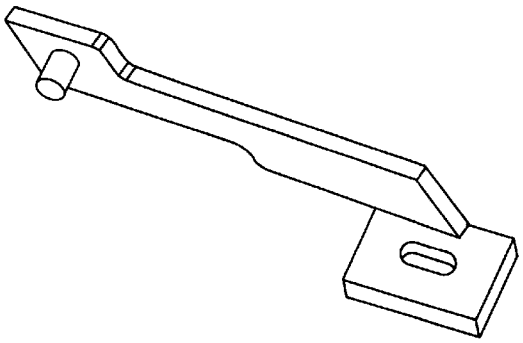
FIG. 1B PRIOR ART
Figure 1C:
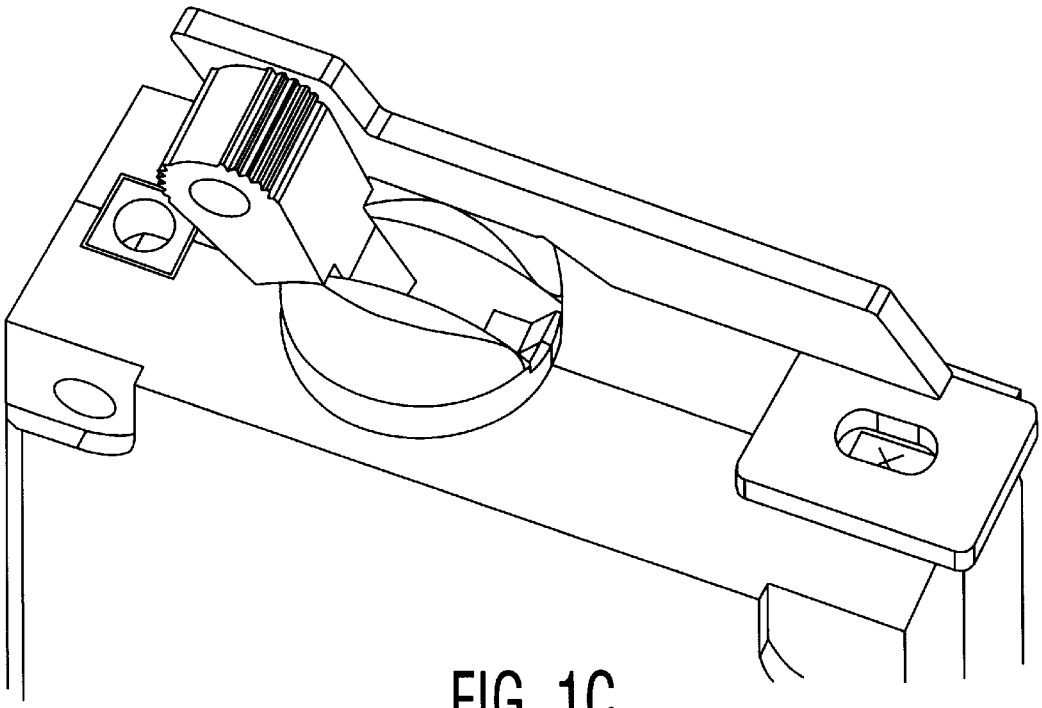
FIG. 1C PRIOR ART
Figure 2A:
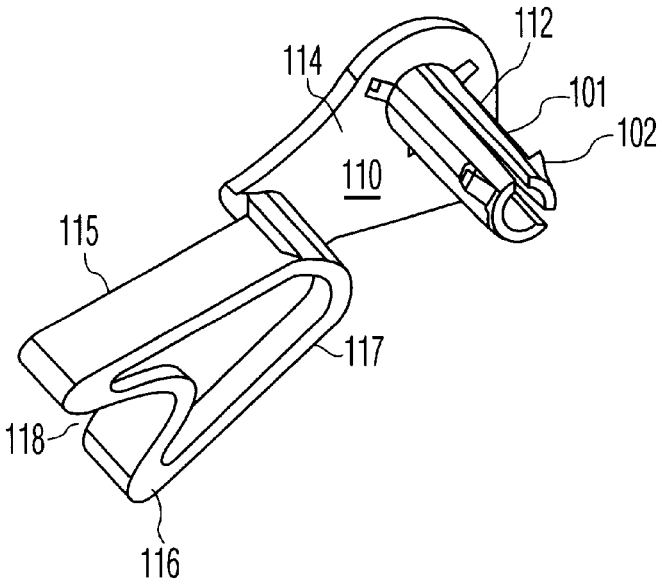
FIGS. 2A, 2B, 2C and 2D show respective top perspective, rear perspective, front view and rear view of a switch stop in accordance with a first embodiment the present invention.
Figure 2B:
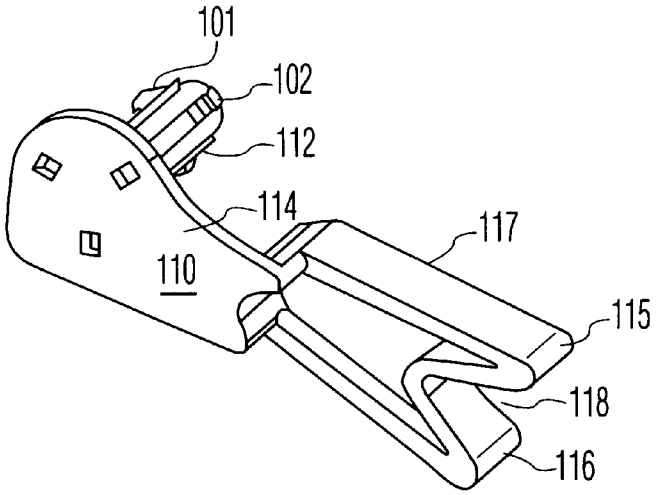
Figure 2C:
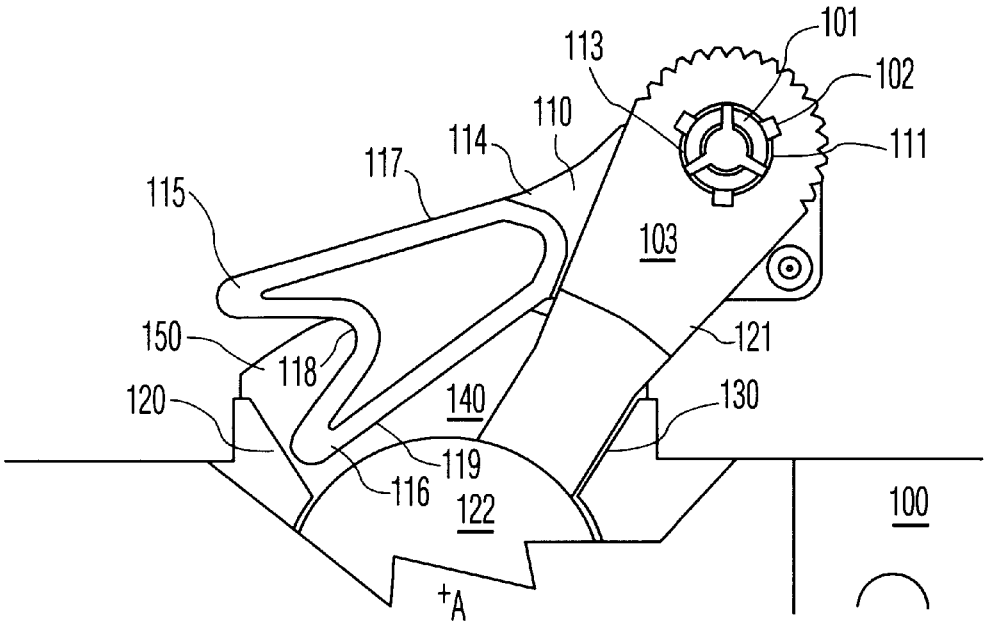
Figure 2D:
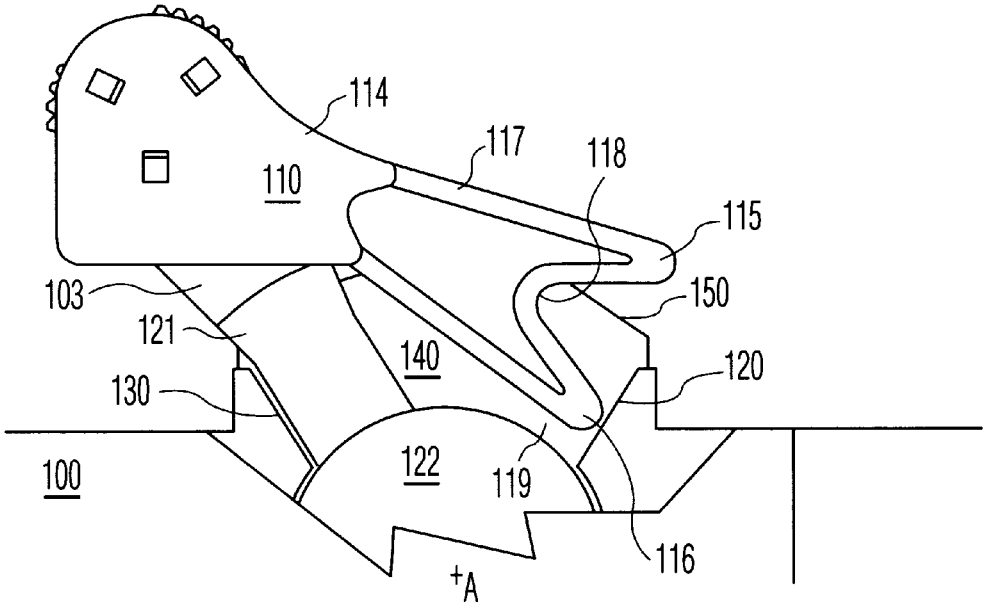
Figure 3A:
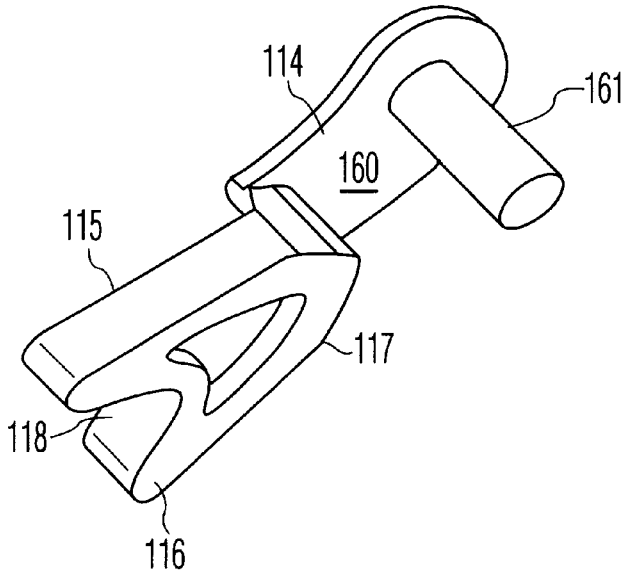
FIGS. 3A, 3B, 3C and 3D show respective top perspective, rear perspective, front view and rear view of a switch stop in accordance with a second embodiment of the present invention.
Figure 3B:
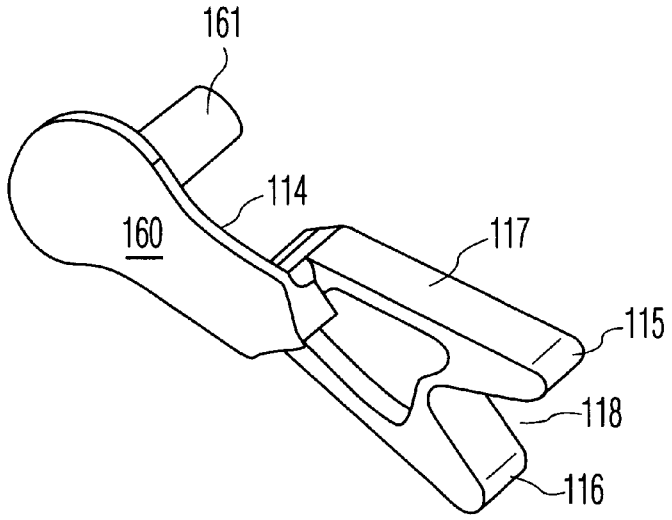
Figure 3C:
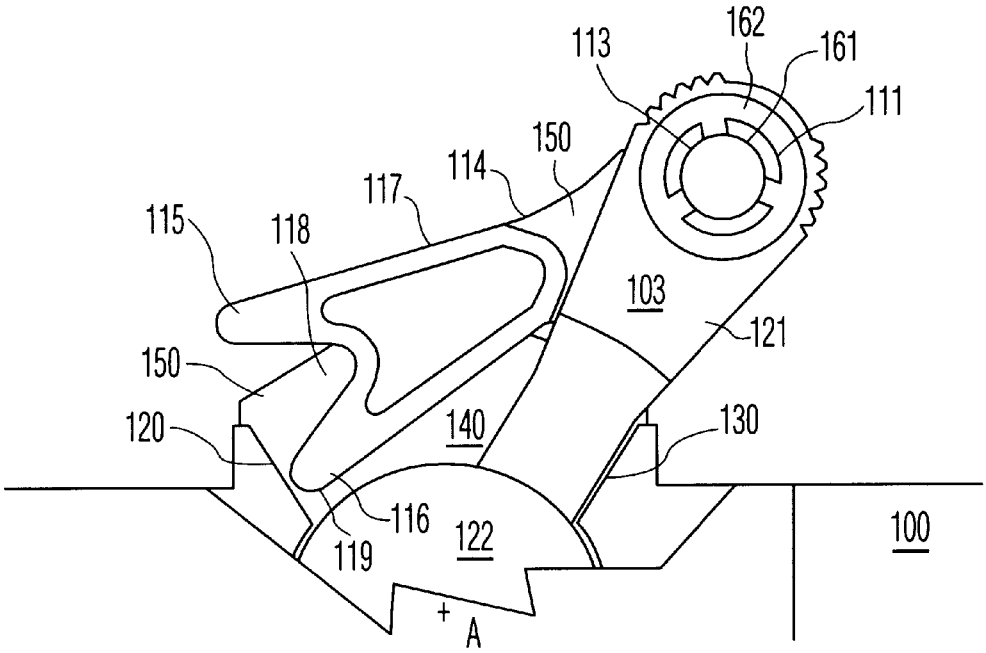
Figure 3D:
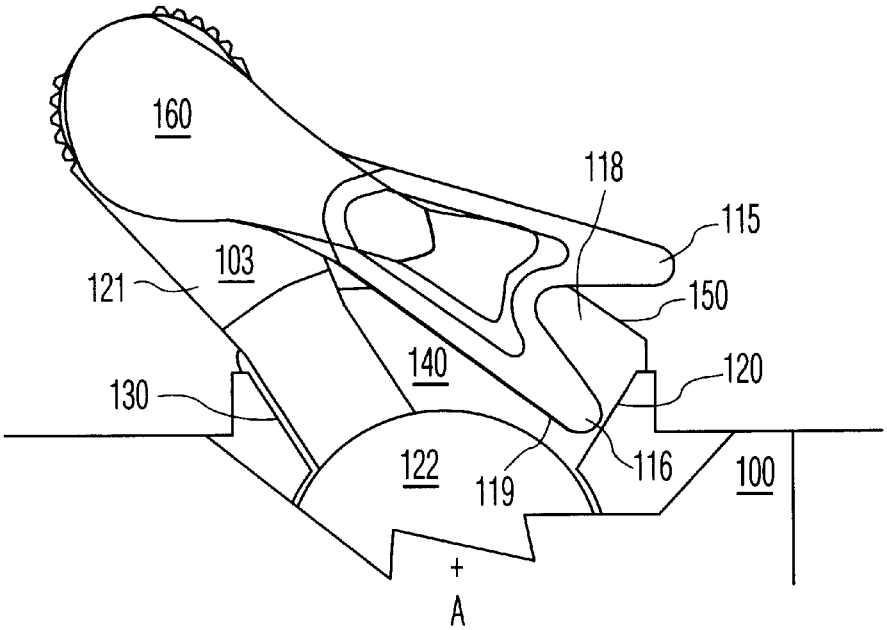

The invention will now be described by way of the drawings, in which corresponding reference numerals indicate corresponding structures in the figures.

EXAMPLE 1

A first configuration of the retaining member according to the present invention is shown in FIGS. 2A, 2B, 2C, and 2D. The retaining member 101 attaches to a standard-type toggle switch 100, at a portion distal to the toggle 103 pivot axis A, by means of resilient catches 102. The retaining element 110 pivots about its attachment point 111 to provide a first position in which the retaining element 110 engages a portion 120 of the switch 100 body at a position displaced from the toggle pivot axis A. The retaining element 110 is relatively rigid and incompressible, so that this engagement prevents movement of the toggle 103 in the direction of the retaining element 110. The retaining element 110 also has an unengaged position (not shown), in which the retaining element 110 does not impede movement of the toggle 103 from a respective position. To move between the engaged and unengaged position, the retaining element 110 is manually "flipped" about its attachment point 101, thus clearing the path of movement.

The retaining element 110 is constituted of a cylindrical rod-like extension 112, forming an axle for rotation. This cylindrical rod-like element 112 extends somewhat greater than the thickness of the distal end of the toggle 103 along its axis of displacement A. The cylindrical rod-like element 112 passes through a hole 113 parallel to the axis A of toggle 103 movement near the end of the toggle 103 handle, and is held in place by the expansion of the resilient catches 102 outside the aperture 113.

Perpendicular to the cylindrical rod-like element 112 is an extension 117, which further merges with two diverging arms 115, 116 in a forked arrangement. Between the cylindrical rod-like element 112 and the extension 117 is a clearance portion 114, adapted to avoid interference with structures on the switch disposed along the path of the retaining element 110.

The tip of each arm 115, 116 is adapted for two functions; first, to interlock with a portion of the switch body 120 to prevent displacement of the toggle 103 in the direction of the extension 117, and second, to facilitate manual grasping to disengage the retaining element 110. These functions are not performed simultaneously, but rather, one arm 115, 116 prevents movement while the other arm 116, 115 facilitates grasping.

A recess 140 is provided in the switch 100 body by a set of diverging walls 120, 130, inclined at about right angles, each of which defines a limit position for the toggle 103. The toggle 103 includes a handle portion 121 which subtends an angle of about 15 degrees and a cylindrical portion 122 having a cylinder axis coincident with the axis A of toggle movement. With the toggle 103 in either limit position, there is thus a gap of about 75 degrees in the recess 140, bounded interiorly by a cylindrical portion 122 of the toggle, by the toggle handle portion 121 on one side (near 130) and a wall 120 of the recess 140 on the other side, and by two side walls 150.

Each distal arm 115, 116 of the retaining element 110 swings through an arc which intersects the wall 120 of the recess 140 by a small amount, resulting in interference. Thus, a small force is necessary to engage or disengage the retaining element 110, holding it in place.

The indentation between the 118 two diverging arms 115, 116 serves the purpose of providing an acute angular surface which engages the portion 120 of the switch 100 body which defines a recess 140 between the switch 100 body and toggle 103 along the path of toggle 103 movement, so that when the retaining element 110 is engaged, the path of the toggle 103 through the recess 140 is impeded. The side 119 of the retaining element 110 rests against the cylindrical portion 122 of the toggle 103, and is preferably concave contoured to mate with this surface. The indentation 118 also relieves pressure against the lateral wall 120 of the recess 140, and thus causing the tip of the arm 116 to exert the pressure against the switch 100 body. When a force is applied to the toggle 103 to change the switch 100 position, since the tip of the arm 116 is closer to the axis A of toggle 103 movement than the interfering portion of the lateral wall 120 of the recess 140, the tip of the retaining element arm 115 is wedged further into the recess 140.

The indentation 118 also provides an acute angle of the upwardly extending arm 115 which increases the manual traction for grasping the retaining element 110. When the retaining element 110 is in the unengaged position, it may also serve as an extension of the toggle 103, facilitating grasping of the toggle 103 and actuating the switch 100.

EXAMPLE 2

The switch stop shown in FIGS. 3A, 3B, 3C, and 3D, is essentially similar to the switch stop shown in FIGS. 2A, 2B, 2C and 3D, with the exception that the rod-like element 112 of FIGS. 2A, 2B, 2C and 3D is replaced with a cylindrical element 161, which is held to the toggle 103 handle 121 by a retaining clip 162. The extension 114 is also shaped differently.

EXAMPLE 3

Figure 4:
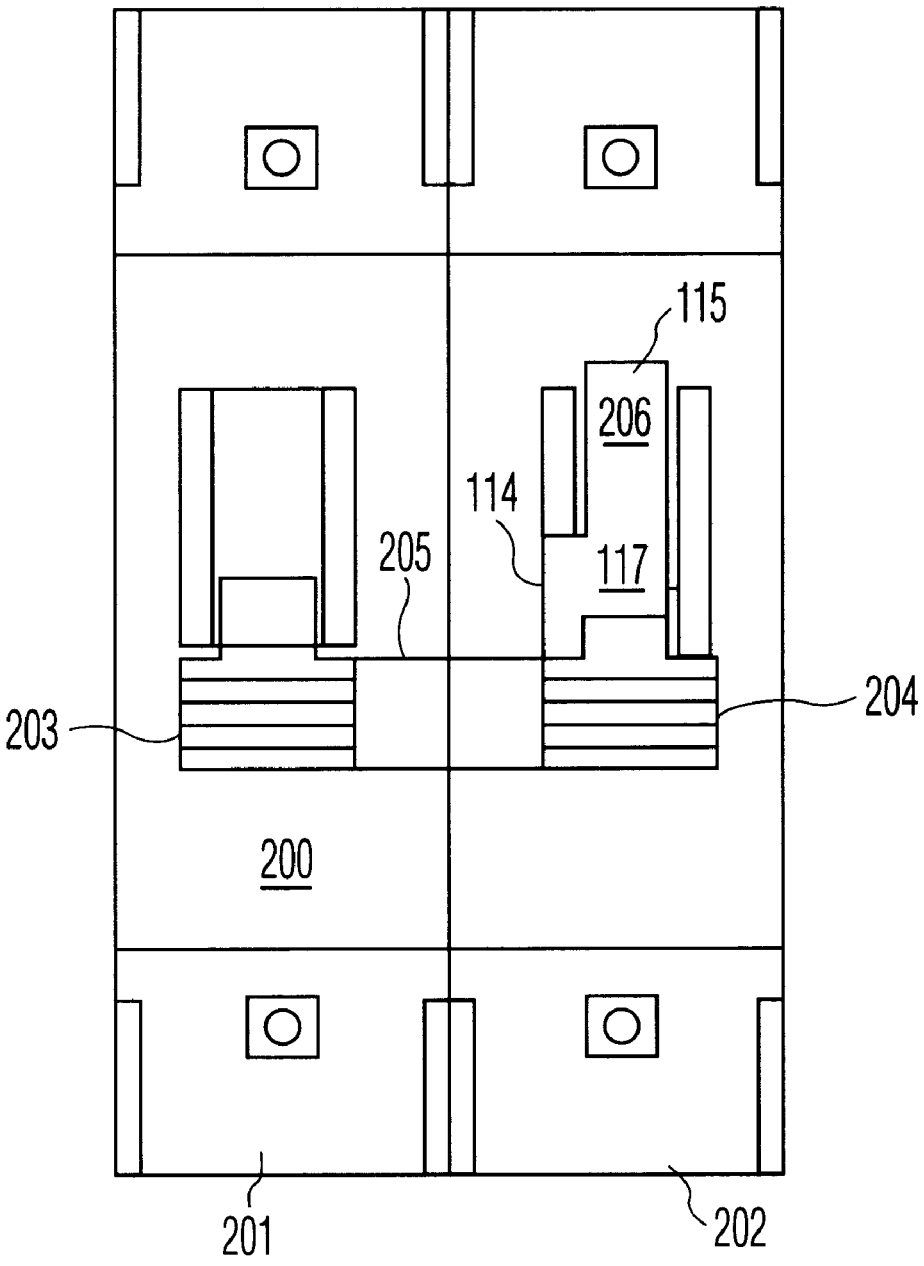
FIG. 4 shows a top view of a dual pole circuit breaker with a switch stop in accordance with a third embodiment of the present invention.

In an alternate embodiment, a multipole toggle switch arrangement 200 is provided. In this case, a plurality of switches 201, 202 are ganged, or placed side-by-side, with individual toggles 203, 204 extending forward. A mechanical element 205 typically links the separate toggles 203, 204 so that they move together. According to the present invention, this mechanical linking element 205 also serves the retaining function according to the present invention. Therefore, one or more retaining elements 206 may be provided for the set of toggles 203, 204. If multiple retaining elements are provided, it is preferable that these be linked for rotation about the pivot axis together. Otherwise, the retaining element may be a separate element 206 added to the existing mechanical linking element 205. Thus, as shown in FIG. 4, the extension 114 and forked arm 115, 116 arrangement are essentially as described in Example 1. The cylindrical rod-like element 112 or cylinder 161 and retaining clip 162 are modified to form a mechanical linking element between two adjacent poles 201, 202.

While the above detailed description has shown, described and pointed out the fundamental novel features of the invention as applied to various embodiments, it will be understood that various omissions and substitutions and changes in the form and details of the system and method illustrated may be made by those skilled in the art, without departing from the spirit of the invention. Consequently, the full scope of the invention should be ascertained by the appended claims.

What is claimed is:

1. A retaining element for a toggle, said toggle having an elongated member which pivots about an axis with respect to a body, comprising:

an attachment, connecting the retaining element to the toggle and being capable of supply a force against the elongated member of the toggle to hold the toggle in a defined position;

an arm, extending from the attachment, capable of supplying a force in said defined position against the body with respect to a path of movement of the toggle;

a manually graspable member, adapted to transmit a force for pivotally displacing the attachment from the defined position and thereby pivotally disengaging the rigid arm from the body, and a body portion of the retaining element, having proximal portion resting against the elongated member of the toggle in the defined position and terminating distally said arm and said manually graspable member, wherein said arm and manually graspable member are symmetric.

2. The retaining element according to claim 1, wherein the toggle actuates an electrical switch.

3. The retaining element according to claim 1, wherein the body defines a recess in which the toggle is disposed, the arm resting against a wall of the recess in said defined position.

4. The retaining element according to claim 1, wherein the toggle further comprises a cylindrical portion having a cylindrical axis coincident with an axis of movement of the toggle, said arm resting against the cylindrical portion in the defined position.

5. The retaining element according to claim 1, wherein said toggle has a first defined position and a second defined position, said arm and said manually graspable member being symmetric extensions, such that a first symmetric extension is capable of supplying a force in said first defined position against the body with respect to a path of movement of the toggle and said second symmetric extension is adapted to transmit a force for displacing the attachment from the first defined position; and said second symmetric extension is adapted to supply a force in said second defined position against the body with respect to a path of movement of the toggle and said first symmetric extension is adapted to transmit a force for displacing the attachment from the second defined position.

6. The retaining element according to claim 1, wherein said attachment comprises a cylindrical rod parallel to the axis of toggle movement, passing through a portion of the elongated member of the toggle.

7. The retaining element according to claim 1, wherein said attachment links a plurality of toggles for movement together.

8. The retaining element according to claim 1, wherein the body defines a recess having diverging walls, wherein said arm pivots about an axis defined by said attachment to define a path which interferes with a portion of one of the walls, the toggle being limited by the other of the walls.

9. The retaining element according to claim 1, wherein said attachment comprises a member passing through an aperture in the toggle, further comprising a clip for holding said member in said aperture.

10. The retaining element according to claim 1, wherein said arm is rigid.

11. The retaining element according to claim 1, wherein the toggle and body comprise an electrical circuit breaker.

12. The retaining element according to claim 1, further comprising a "V"-shaped recess between said arm and said manually graspable member.

13. A retaining element for a toggle switch, the toggle switch having a switch body, a recess in the switch body, and a toggle extending from the recess out of the switch body, comprising:

(a) a pivot member attached to a distal portion of the toggle, and pivoting about an axis defined by the distal portion of the toggle;

(b) a rigid connecting arm, linked to said pivot member, freely rotating about the axis, symmetrically terminating distally in an engaging portion and means capable of manual engagement and disengagement of the retaining element; and (c) said engaging portion being affixed to said rigid connecting arm distal to said pivot member and being adapted, in a first position, to engage a portion of the recess in the switch body for preventing a displacement of the toggle and being adapted, outside the first position, to disengage the portion of the recess in the switch body for allowing a displacement of the toggle.

14. The retaining element according to claim 13, wherein said toggle switch is an electrical circuit breaker.

15. The retaining element according to claim 13, wherein the engaging portion passes through an interference region with respect to a wall of the recess during engagement thereof.

16. A method for retaining a toggle switch in a defined position, the toggle switch having a switch body, a recess in the switch body, and a toggle extending from the recess out of the switch body, comprising the steps of:

(a) providing a pivot member attached to a distal portion of the toggle, a rigid connecting arm, linked to said pivot member and having a body resting against the distal portion of the toggle, freely rotating about said pivot member with respect to the toggle; an engaging portion, affixed to said rigid connecting arm distal to said pivot member and being adapted to engage a portion of the recess in the switch body for preventing a displacement of the toggle and to disengage the portion of the recess in the switch body for allowing a displacement of the toggle, and a distinct graspable member, wherein said engaging portion and said distinct graspable member are symmetric; and (b) manually engaging the engaging portion with the recess to restrain movement of the toggle by means of said distinct graspable member.

* * * * *